US011253068B2

(12) United States Patent
Geyer et al.

(10) Patent No.: US 11,253,068 B2
(45) Date of Patent: Feb. 22, 2022

(54) LEVELERS FOR STABILIZING FURNITURE AND ITEMS WITH FEET

(71) Applicant: Level-Minded LLC, Allison Park, PA (US)

(72) Inventors: James R. Geyer, Manns Choice, PA (US); David A. Geyer, Allison Park, PA (US)

( * ) Notice: Subject to any disclaimer, the term of this patent is extended or adjusted under 35 U.S.C. 154(b) by 0 days.

(21) Appl. No.: 17/197,120

(22) Filed: Mar. 10, 2021

(65) Prior Publication Data

US 2021/0282552 A1 Sep. 16, 2021

Related U.S. Application Data

(60) Provisional application No. 62/987,601, filed on Mar. 10, 2020.

(51) Int. Cl.
*A47B 91/00* (2006.01)
*A47B 91/12* (2006.01)

(52) U.S. Cl.
CPC ..... *A47B 91/005* (2013.01); *A47B 91/12* (2013.01)

(58) Field of Classification Search
None
See application file for complete search history.

(56) References Cited

U.S. PATENT DOCUMENTS

| | | | | | |
|---|---|---|---|---|---|
| 1,798,272 | A * | 3/1931 | Phillips | A47B 91/04 | 248/188.2 |
| 1,887,283 | A * | 11/1932 | Brabson | A47B 91/12 | 248/346.11 |
| 5,345,631 | A * | 9/1994 | Saperstein | A47C 19/024 | 248/188.2 |
| 9,033,293 | B1 * | 5/2015 | Glenn | A47B 91/005 | 248/188.2 |
| 9,841,137 | B1 | 12/2017 | Pierce | | |
| 10,479,553 | B2 * | 11/2019 | Guerry | B65D 19/385 | |
| D915,871 | S * | 4/2021 | Wendling | D8/374 | |
| 2008/0308015 | A1 * | 12/2008 | Apps | B65D 19/004 | 108/53.3 |
| 2010/0147198 | A1 * | 6/2010 | Palmer | B65D 19/004 | 108/53.3 |
| 2010/0186639 | A1 * | 7/2010 | Schiava | B65D 19/0016 | 108/57.27 |
| 2014/0020234 | A1 * | 1/2014 | Luis y Prado | F16M 11/00 | 29/592 |
| 2014/0319302 | A1 * | 10/2014 | Baltz | B65D 19/004 | 248/346.02 |
| 2018/0099779 | A1 * | 4/2018 | Apps | B65D 19/0008 | |
| 2018/0334284 | A1 * | 11/2018 | Kroeker | B65D 19/0018 | |
| 2020/0146448 | A1 * | 5/2020 | Wendling | A47B 91/005 | |

* cited by examiner

*Primary Examiner* — Steven M Marsh

(57) ABSTRACT

A leveler for stabilizing furniture and other items which may be stacked one upon another in a stackable fashion. One or more stackable levelers may be used for many indoor, garage, patio, pool, and outdoor applications. In addition to stabilizing furniture, including tables, chairs, shelving, desks, beds, sofas, and anything with feet and/or legs, the levelers may be used in various camping and outdoor applications, including for stabilizing ladders, appliances, and kickstands.

20 Claims, 11 Drawing Sheets

LEVELERS FOR STABILIZING FURNITURE AND ITEMS WITH FEET

PRIORITY CLAIM

This application claims priority to U.S. Provisional Application No. 62/987,601 filed on Mar. 10, 2020, hereby incorporated by reference in its entirety.

FIELD

This invention relates to a leveler and more particularly to a stackable leveler wherein levelers may be stacked one upon the other to stabilize a piece of furniture and other items and for other various indoor and outdoor uses.

BACKGROUND OF THE INVENTION

The present invention is directed to a stabilizing device, which is adapted for insertion between a support surface and the lower support structure of an article in order to help support and stabilize the article against instability that is caused by an uneven structural support of the article or the support surface. This instability results in tipping, wobbling, or vibration when the distribution of weight on the article is disturbed by jarring forces, and the like. The stabilizing device thus may also be used to help level an otherwise evenly supported article on an uneven support surface. Accordingly, the present invention is directed to the leveling and stabilizing of articles, such as furniture and the like, which rest on a support surface, such as a floor, in order to prevent wobbling, tipping, or vibration during use.

Most articles of furniture are constructed to have a lower support structure, which defines a support plane at its lowermost points. The operative or working areas of the article of furniture are then oriented in a desired manner with respect to that support plane by the support structure. For example, a typical table has a horizontal dining surface, which is oriented parallel to the floor and supported by four downwardly depending legs. Thus, the support plane of this table is the plane defined by the free ends of the legs. However, planar geometry dictates that only three operative support points define a plane. Thus, it is necessary that the table legs be sized with great care in order to ensure that all four free ends terminate in a common plane; otherwise, the table will be unstable. When this happens, the article does not have a single stable support plane but rather is subject to unwanted wobbling, tipping, or as in the case of machinery—vibrating. Even articles, which have only three support points, such as a three-legged table, that automatically define a stable support plane, can still have the problem that the working surface may not be in the desired orientation due to any error in the intended length of any support.

Other articles that have rotating components, such as appliances such as washing machines, pumps, air-conditioners, fans, and the like, can vibrate if not properly leveled and stabilized. For example, an air-handling unit might include a fan. If the fan is not perfectly balanced then any instability in the support of the air-handling unit on its support surface might allow the unit to vibrate. In some cases this vibration can be sufficient to cause damage to the unit. Also, the vibration can cause unwanted noise.

Accordingly, there has been a long-felt need for mechanical structures and devices, which can level or otherwise stabilize articles. To this end, some articles are provided with adjustable pads on their lower supports with these pads typically being threaded bolts which terminate in support pads or heads. These threaded bolts move into and out of the lower supports to define an adjustable support plane. Thus, the support pads may be adjusted by threading so that all of the common support points are in a common plane. Other techniques of leveling items such as heavy machinery include the use of a pair of freely sliding wedges, which are interconnected by means of a threaded shaft; a torque applying assembly interconnects the wedges so that they may be forcibly slid with respect to one another to provide vertically adjustable supports for the machine.

U.S. Pat. No. 4,830,320 is directed to a wedge shaped device, which is able to be inserted between a support surface and a lower portion of an article in order to help stabilize and level the article on the support surface. This device is low cost, convenient, and adaptable to many applications where leveling, shimming or stabilizing is needed. This earlier device has been found to be useful not only for leveling and stabilizing furniture, but also for shimming work projects, vibration control of industrial equipment, and surface protection to name a few applications. While known wedge devices are convenient for many applications, there is still a need for a device, which is particularly adapted for certain applications, such as outdoor and camping.

In addition to the wedge shaped stabilizers, other prior art devices known as furniture risers enable furniture such as beds, desks and sofas to be raised above the floor. Furniture raisers are used to raise the height of a piece of furniture, such as a bed for an elderly person or a desk to fit a taller person.

The present invention may be used to both stabilize furniture and to raise it to a desired height. The present invention is low cost, small, able to be stacked easily, designed for both indoor and outdoor use, and provides for a means stabilizing furniture and any other items with legs and/or feet.

SUMMARY OF THE INVENTION

A leveler, a system including two or more stacked levelers, and methods of using the levelers are described herein. Each leveler comprises a horizontally disposed top surface that is either square or substantially circular or any other simple stackable shape that measures about 1.5 to about 4 inches in horizontal width or diameter. Each leveler comprises a wall extending upwardly from said top surface around an outer edge of the top surface, wherein the wall comprises four notches that are an empty space, wherein the four notches are preferably positioned around the top surface at four equidistant positions around the perimeter of the top surface, wherein said wall has a height of about 0.05 inches to about 0.75 inches measuring upwardly from the top surface. The leveler further includes a horizontally disposed bottom surface, wherein the bottom surface substantially corresponds to the measurements of the top surface, wherein the bottom surface comprises 4 to 5 feet, wherein 4 to 5 feet have a height of about 0.05 inches to about 0.75 inches, wherein the first four feet are positioned in between the four notches of the top surface and are offset from an outer most perimeter of the bottom surface such that the feet are capable of fitting within a wall of a second leveler, and wherein the optional fifth foot is positioned in the middle of the bottom surface.

DETAILED DESCRIPTION OF THE INVENTION

Figure 1:
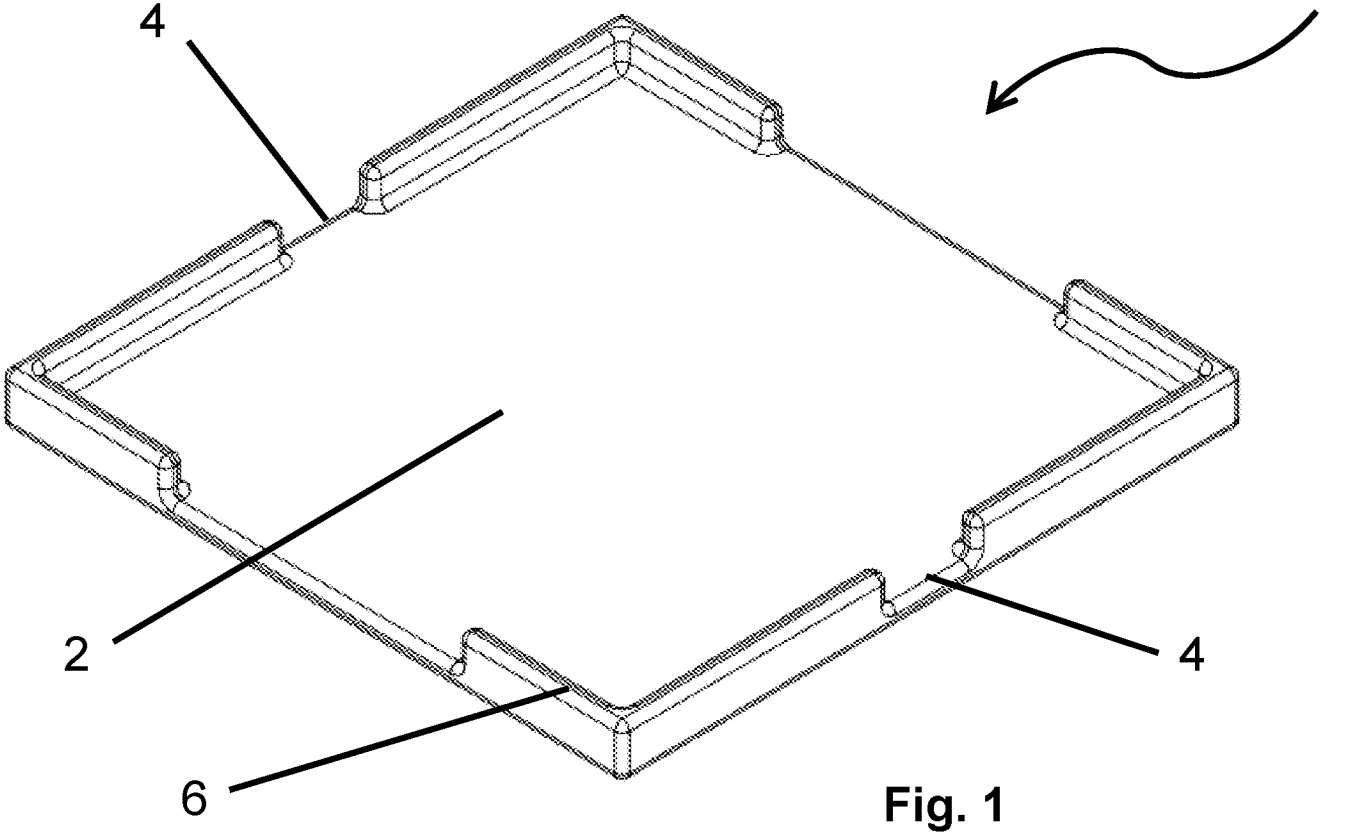
FIG. 1 is a perspective view of the top of a leveler.
Figure 2:
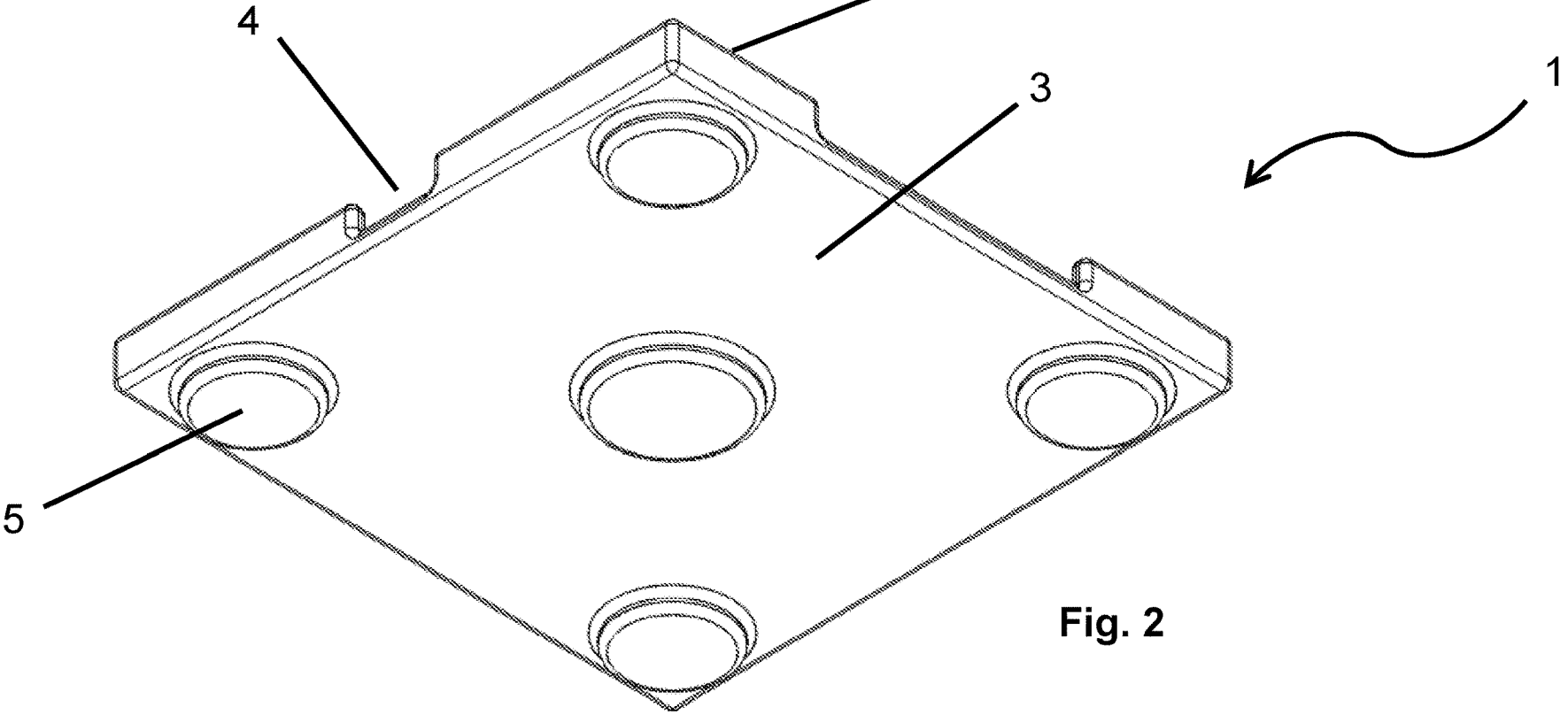
FIG. 2 is a perspective view of the bottom of a leveler.
Figure 3:
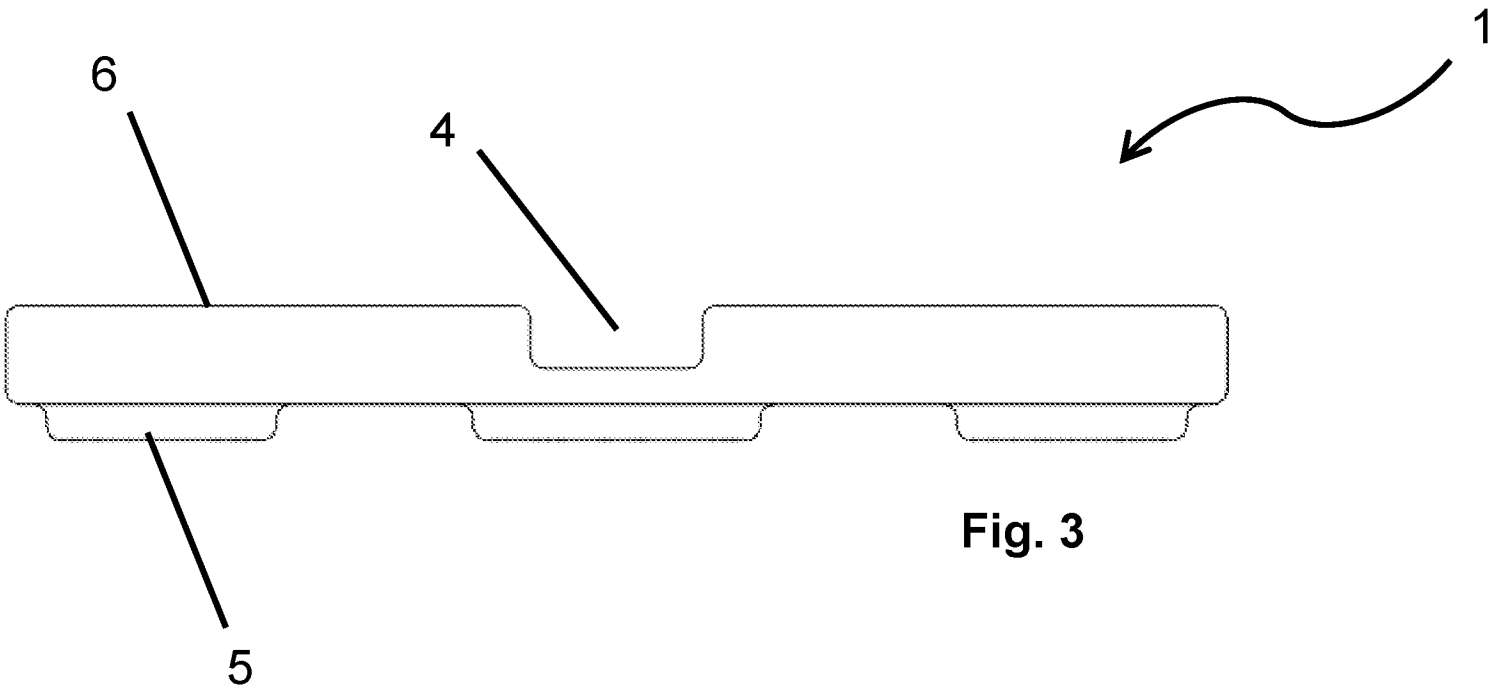
FIG. 3 is a side view of a leveler.

A leveler for stabilizing furniture and other items is herein described and designed to be stacked one upon another in a stackable fashion. One or more stackable levelers may be used for many indoor, garage, patio, pool, and outdoor applications. In addition to stabilizing furniture, including tables, chairs, shelving, desks, beds, sofas, and anything with feet and/or legs, the levelers may be used in various camping and outdoor applications, including for stabilizing ladders, outdoor furniture, and kickstands. Water heaters and other appliances may also be stabilized with the levelers described herein.

The levelers or stabilizing devices may be constructed of any suitable material. The leveler may be formed by injection molding with a high-friction material, which is operative to prevent slippage once it is inserted between the lower support structure of the article of furniture and the support surface. Additionally, the leveler may be 3D printed using known materials, such as with a suitable epoxy resin or a plastic resin that is similar to Acrylonitrile Butadiene Styrene (ABS) plastic. The leveler may be constructed of a relatively stiff yet flexible material and may be a plastic material selected from a group consisting of polypropylene, polyethylene, polystyrene, polycarbonate, polylactic acid (PLA), acetal, and the like. Alternatively, the leveler may be constructed of a soft gripping material such as polyethylene, polyvinylchloride (PVC), rubber, or the like. Additionally, other materials may be used to construct the levelers, including wood and metal (specifically aluminum and steel). Other materials known in the art, plastic or otherwise, are also contemplated by this invention.

The leveler may be made of different materials to suit different applications and different weights. In a preferred embodiment, the levelers will be able to stabilize an object with a weight of up to 500 pounds and in a more preferred embodiment, a weight of up to 1000 pounds.

For example, if indoor use is contemplated, the levelers may also include a felt layer on the 4-5 feet, similar to an adhesive felt furniture pad. The felt layer may provide a layer of protection to prevent scratching of the flooring. Further, the bottom leveler may have a felt layer, but other additionally levelers stacked thereon may not necessarily need the felt layer. Variety packs may be sold containing different shaped and sized levelers with different features.

With reference to the figures, each leveler 1 comprises a horizontally disposed top surface 2 that is either square or substantially circular or any other simple stackable shape (such as, rectangular, hexagonal, and octagonal) that measures about 1.5 to about 4 inches in horizontal width or diameter.

The levelers 1 have a wall 6 extending upwardly from the top surface 2 around an outer edge of the top surface 2. As depicted, the wall 6 has four notches 4 that are positioned around the top surface, preferably, at four equidistant positions around the perimeter of the top surface. Alternatively, the notches 4 may be spaced at different non-equidistant positions around the top surface. The four notches 4 are empty spaces. These may be all of the same size, or, as depicted, there may be two notches that are larger than the other two notches. The notches serve two purposes. In outdoor use, they may act to drain out water or rain. Additionally, feet of furniture may extend through the notches.

The notches 4 may be positioned at the four corners of the leveler, or, as depicted, in the middle of the four sides of the wall 6 about the perimeter of the top surface 2. These may be all of the same size, various sizes, or, as depicted, there may be two notches that are larger than the other two notches.

The wall 6 has a height of about 0.05 inches to about 0.75 inches measuring upwardly from the top surface 2. The leveler 1 further includes a horizontally disposed bottom surface 3, wherein the bottom surface 3 substantially corresponds to the shape and measurements of the top surface 2, meaning that if the top surface 2 is substantially circular, so is the bottom surface 3. The top 2 and bottom 3 surfaces may be other shapes, including oval, square (depicted), rectangular, hexagonal, and octagonal.

The notches 4 may be placed equidistantly around any shaped leveler 1. In the case of a substantially circular leveler 1, the notches 4 may be placed at positions corresponding to 12 o'clock, 3 o'clock, 6 o'clock, and 9 o'clock.

There is a middle thickness between the top surface 2 and bottom surface 3. That thickness may be about 0.05 to about 1.00 inches. The stackable levelers may be of the same or of different middle thicknesses and still be stackable.

The bottom surface 3 comprises four or five feet 5, wherein the four or five feet 5 have a height of about 0.05 inches to about 0.75 inches, wherein the first four feet 5 are positioned in between the four notches 4 of the top surface 2 and are offset from an outer most perimeter of the bottom surface 3 such that the feet 5 are capable of fitting within a wall 6 of a second leveler of similar height. The optional fifth foot 5 is positioned in the middle of the bottom surface 3. The feet 5 may be circular in shape (as depicted) or may be other shapes, including oval, square, rectangular, hexagonal, and octagonal. The feet 5 may be of varying sizes on the same leveler. The feet 5 may have a diameter of about 0.25 to about 1.00 inch. The optional fifth middle foot may be larger in diameter than the other four feet 5.

Figure 4:
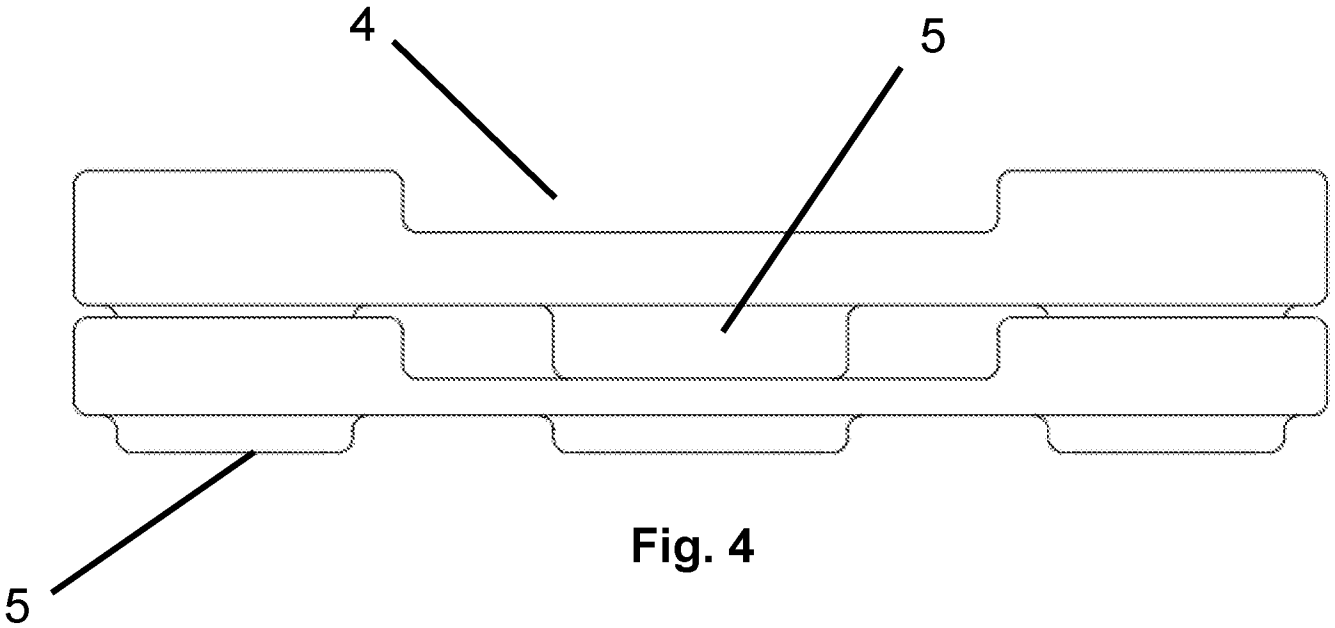
FIG. 4 is a side view of two stacked levelers with their same sized notches aligned.

The top surface 2 and bottom surface 3 complement each other so that a plurality of levelers may be stacked, one on top of the other, thus providing a stabilization system, as seen in FIGS. 4-11. In FIG. 4, two levelers are stacked together and shown from a side view. In FIG. 4, the top leveler's feet 5 are 0.125 inches in height, while the bottom leveler's feet are 0.062 inches in height. The height of the wall 6 of the bottom leveler and the height of the feet 5 of the top leveler are substantially the same to allow for stacking. FIG. 4 shows how two levelers of different middle thicknesses may be stacked together. The middle thickness of the top leveler is 0.125 inches and the middle thickness of the bottom leveler is 0.062 inches as shown in FIG. 4. All other dimensions of the two levelers in FIG. 4 are the same to allow for stacking and easy use.

Figure 5:
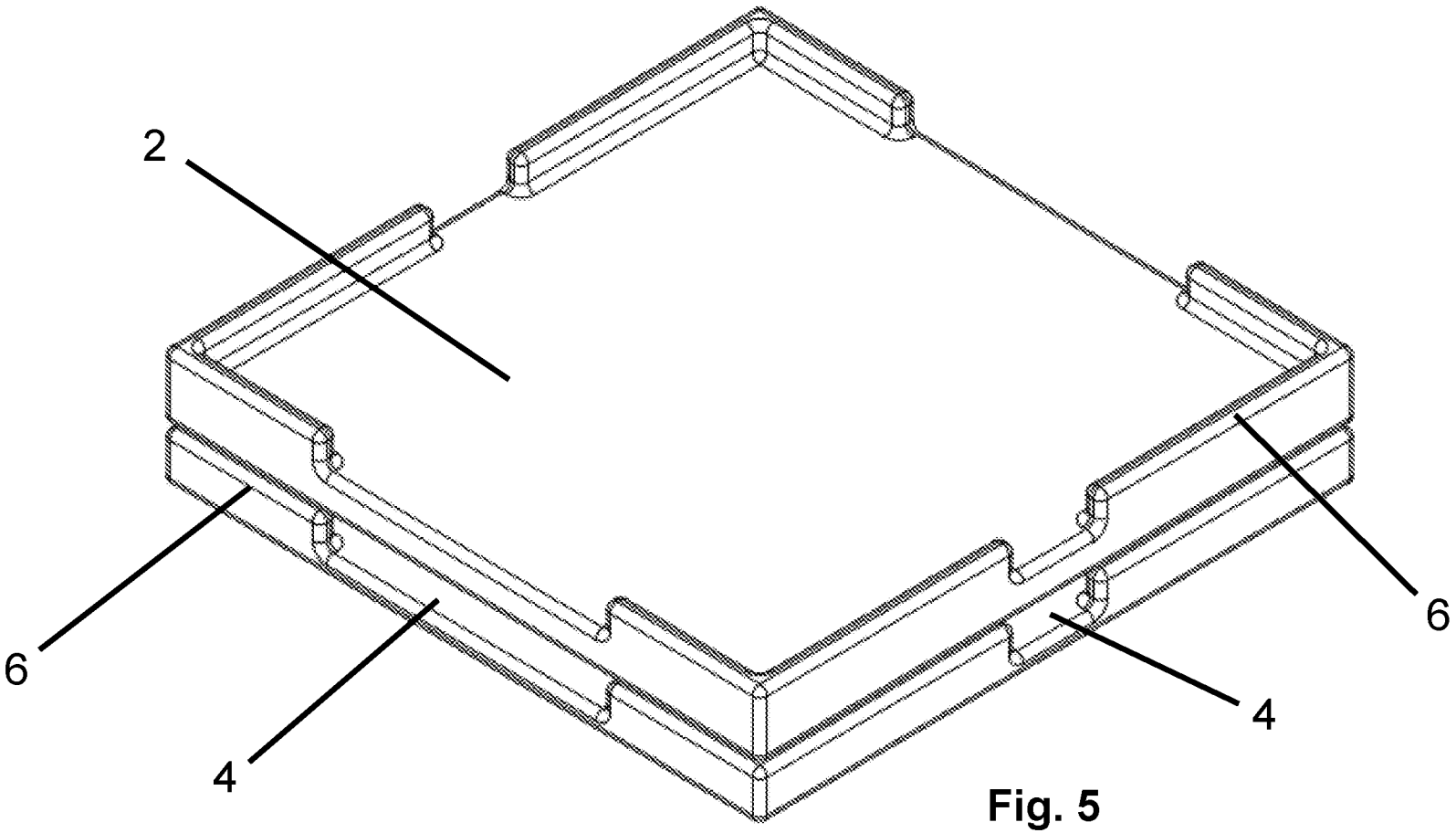
FIG. 5 is a perspective view of two stacked levelers with their same sized notches aligned.

FIG. 5 shows the same two levelers of FIG. 4 in a perspective view. In FIG. 5, the levelers are stacked one on top of the other so that the similarly-sized notches 4 are aligned on top of each other.

Figure 6:
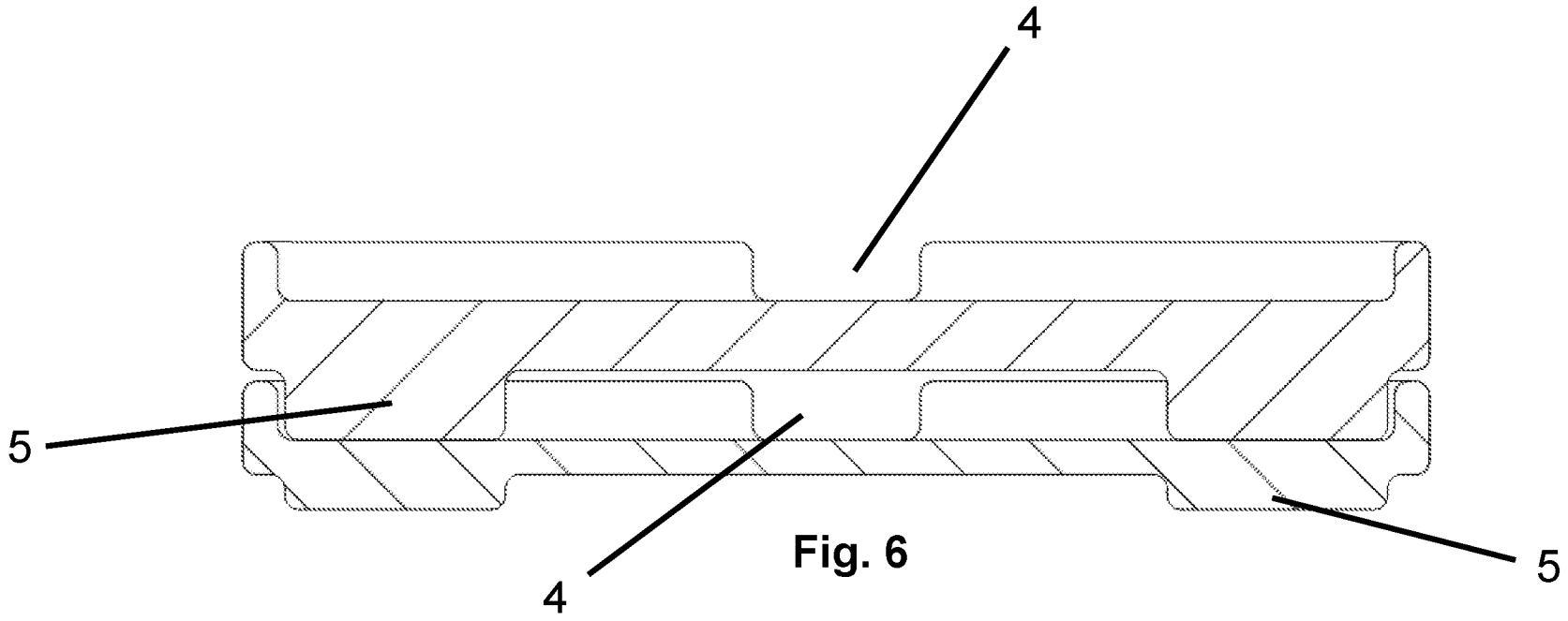
FIG. 6 is a cross sectional side view through the walls, offset from center, of two stacked levelers with their notches aligned, wherein the levelers have different middle thicknesses.

In FIG. 6, two levelers are stacked on top of each other. As also seen in FIGS. 4 and 5, in FIG. 6, the top leveler has a larger middle thickness as the bottom leveler. In FIG. 6, the smaller notches 4 of the top leveler are aligned above the smaller notches 4 of the bottom leveler. In FIG. 6, the cross sectional view is not through the center, but is offset through the walls so as to better illustrate the engagement of the top leveler on the bottom leveler.

Figure 7:
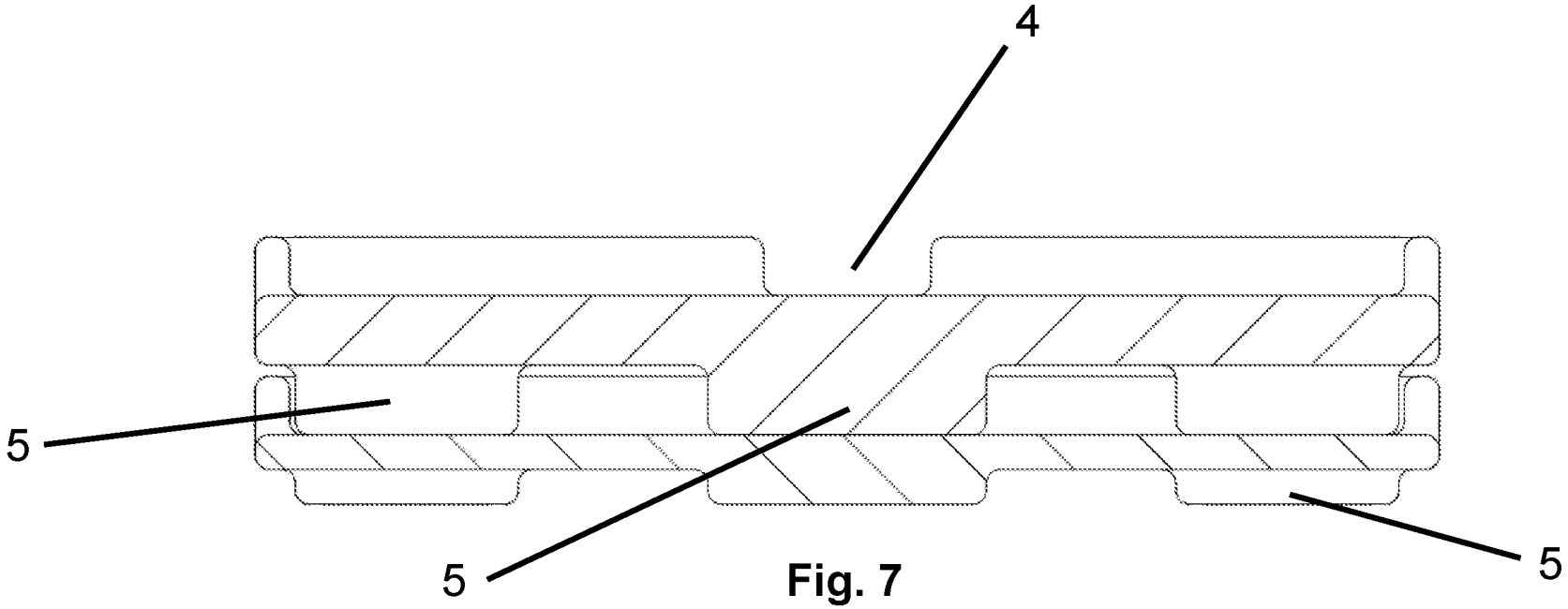
FIG. 7 is a cross sectional side view through the center of two stacked levelers with their same sized notches aligned.

FIG. 7 is a cross sectional side view through the center of two stacked levelers with their similarly-sized notches aligned.

Figure 8:
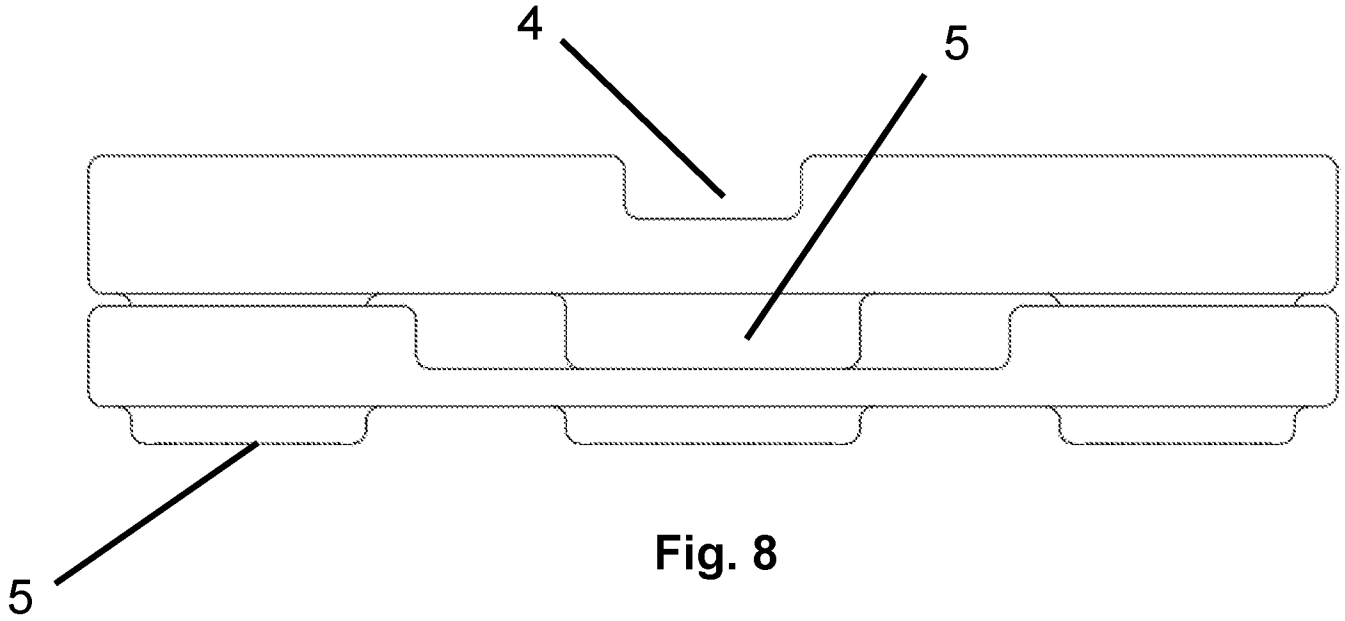
FIG. 8 is a side view of two stacked levelers with their same sized notches opposite.
Figure 9:
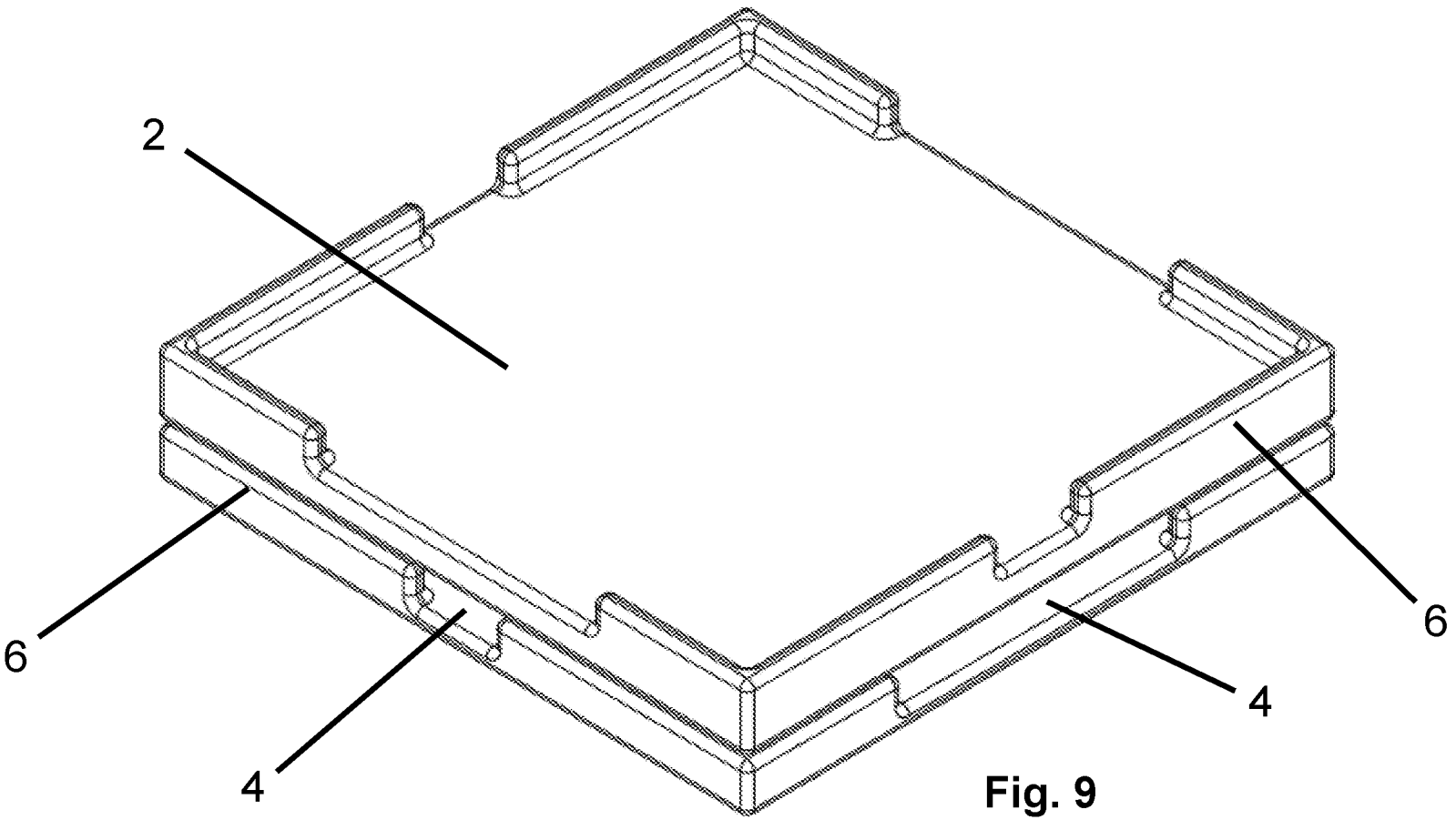
FIG. 9 is a perspective view of two stacked levelers with their same sized notches opposite.
Figure 10:
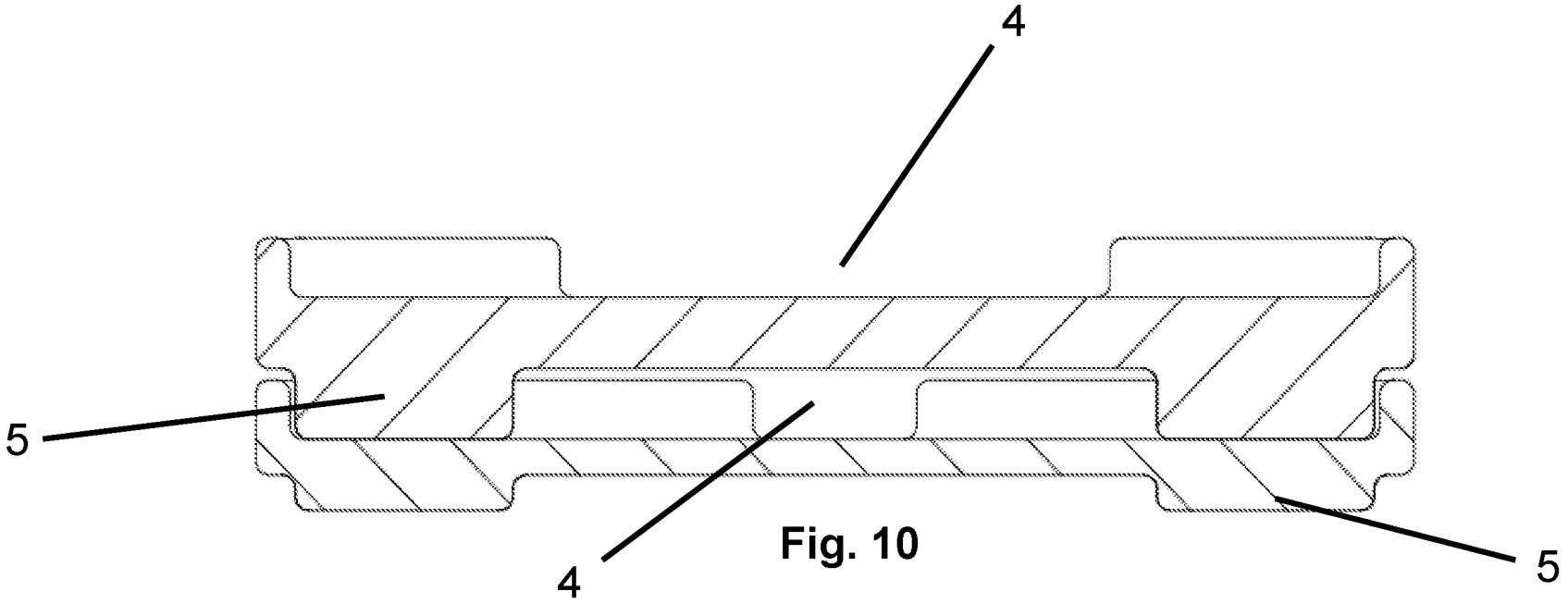
FIG. 10 is a cross sectional side view through the walls, offset from center, of two stacked levelers with their same sized notches opposite.
Figure 11:
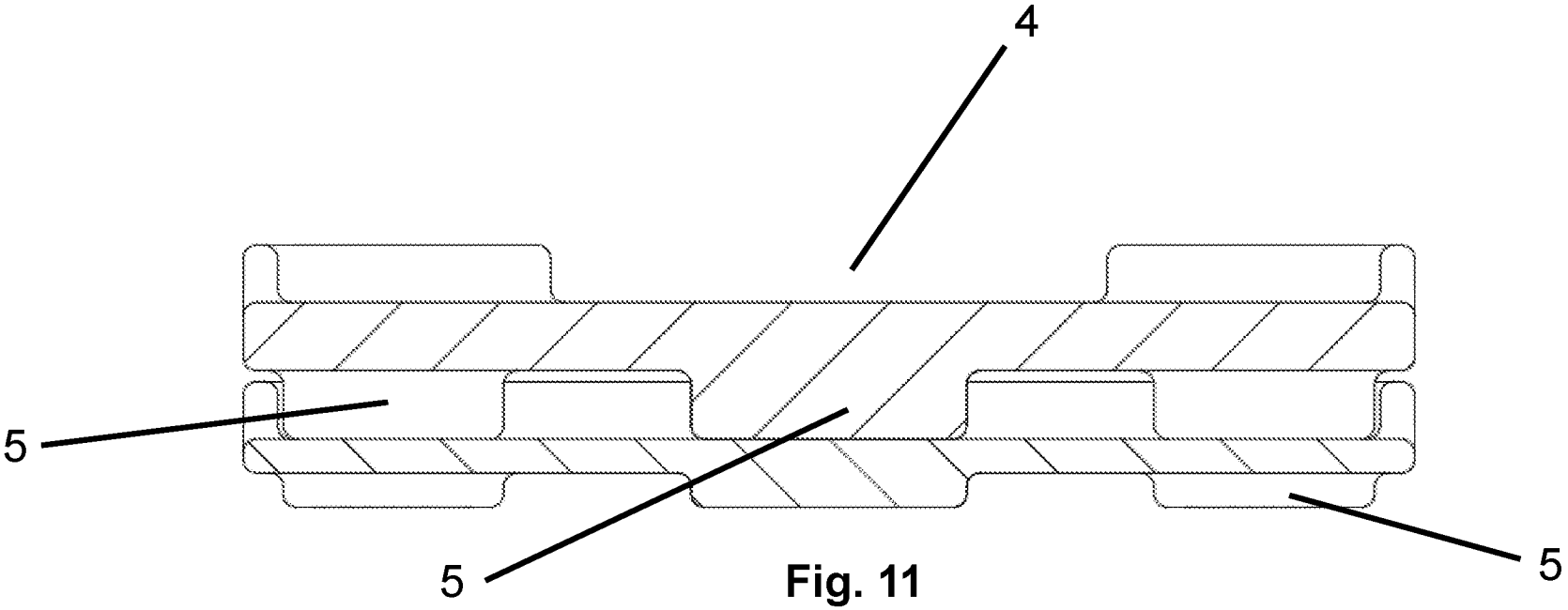
FIG. 11 is a cross sectional side view through the center of two stacked levelers with their same sized notches opposite.

Either position of the similarly-sized notches (aligned as in FIGS. 4-7 or opposite as in FIGS. 8-11) is contemplated by the present system of stackable levelers. FIGS. 8-11 illustrate two stacked levelers with their smaller and longer notches opposite. FIG. 8 is a side view of two stacked levelers with their similarly-sized notches opposite. FIG. 9 is a perspective view of two stacked levelers with their similarly-sized notches opposite. FIG. 10 is a cross sectional side view through the walls, offset from center, of two stacked levelers with their similarly-sized notches opposite. FIG. 11 is a cross sectional side view through the center of stacked levelers with their similarly-sized notches opposite.

The stacked levelers of FIGS. 4-11 each have five feet 5. In one embodiment, a leveler may have feet the height of 0.062 inches. This leveler should be placed on the bottom of a stack. The wall height on this leveler will be the same as all other levelers. Any bottom leveler may also have felt on the bottom of its feet so as to prevent floor scratching.

The figures have been drawn to scale such that the relative dimensions may be determined for the embodiment wherein the notches 4 are equidistantly spaced around the perimeter of the top surface of the leveler and for the embodiment of a leveler with five feet 5. Other embodiments and variations are possible.

The foregoing description of preferred embodiments for this invention has been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated.

What is claimed is:

1. A stackable leveler for leveling an item standing on a surface, comprising:

a horizontally disposed top surface free of recesses or holes measuring about 1.5 to about 4 inches in horizontal width or diameter;

a perimeter wall extending upwardly from the top surface, wherein the perimeter wall comprises at least two notches, wherein each notch is an empty substantially rectangular space in the perimeter wall, wherein the two notches face opposite each other along the perimeter wall, wherein the perimeter wall has a height of about 0.05 inches to about 0.75 inches measuring upwardly from the top surface; and a horizontally disposed bottom surface that is substantially similar to the top surface in shape and size, wherein the bottom surface comprises at least 4 feet, wherein the feet each have a height of about 0.05 inch to about 0.75 inches, wherein the feet are positioned offset from an outer most perimeter of the bottom surface such that the feet are capable of fitting within a perimeter wall of a second similarly shaped and sized stackable leveler.

2. The leveler of claim 1, wherein each of the feet is substantially circular, oval, square, rectangular, hexagonal, or octagonal.

3. The leveler of claim 1, wherein each of the top and bottom surfaces is substantially circular, oval, square, rectangular, hexagonal, or octagonal.

4. The leveler of claim 1, wherein between the top surface and the bottom surface is a middle thickness of the leveler, wherein the thickness is about 0.05 to about 1.00 inch.

5. The leveler of claim 1, comprising five feet, wherein the fifth foot is positioned in the middle of the bottom surface.

6. The leveler of claim 1, comprising two sets of two opposing notches in the perimeter wall.

7. The leveler of claim 6, wherein the four notches are all substantially the same size.

8. The leveler of claim 6, wherein one set of notches that are disposed opposite each other is slightly wider in size than the second set of notches disposed opposite each other.

9. The leveler of claim 6, wherein the four notches are positioned equidistantly around the perimeter wall.

10. The leveler of claim 6, wherein the four feet are positioned in between the four notches of the top surface.

11. A system for leveling an item standing on a surface, comprising two or more stackable levelers, wherein at least one leveler comprises:

a horizontally disposed top surface free of recesses or holes measuring about 1.5 to about 4 inches in horizontal width or diameter;

a perimeter wall extending upwardly from the top surface, wherein the perimeter wall comprises at least two notches, wherein each notch is an empty substantially rectangular space in the perimeter wall, wherein the two notches face opposite each other along the perimeter wall, wherein the perimeter wall has a height of about 0.05 inches to about 0.75 inches measuring upwardly from the top surface; and a horizontally disposed bottom surface that is substantially similar to the top surface in shape and size, wherein the bottom surface comprises at least 4 feet, wherein the feet each have a height of about 0.05 inch to about 0.75 inches, wherein the feet are positioned offset from an outer most perimeter of the bottom surface such that the feet are capable of fitting within a perimeter wall of a second similarly shaped and sized stackable leveler.

12. The system of claim 11, wherein each of the levelers has a middle thickness defined as the width in between the top surface and the bottom surface and wherein each of the levelers of the system has the same thickness.

13. The system of claim 12, wherein the levelers' middle thickness is about 0.05 to about 1.00 inches.

14. The system of claim 11, wherein each of the levelers has a middle thickness defined as the width in between the top surface and the bottom surface and wherein the levelers of the system may have varying thicknesses.

15. The system of claim 14, wherein the levelers' middle thickness is about 0.05 to about 1.00 inches.

16. A method of using one or more levelers to stabilize one or more legs of an item or a piece of furniture comprising:

placing one or more levelers under one or more legs of the item or piece of furniture, wherein the one or more levelers each comprise:

a horizontally disposed top surface free of recesses or holes measuring about 1.5 to about 4 inches in horizontal width or diameter;

a perimeter wall extending upwardly from the top surface, wherein the perimeter wall comprises at least two notches, wherein each notch is an empty substantially rectangular space in the perimeter wall, wherein the two notches face opposite each other along the perimeter wall, wherein the perimeter wall has a height of about 0.05 inches to about 0.75 inches measuring upwardly from the top surface; and a horizontally disposed bottom surface that is substantially similar to the top surface in shape and size, wherein the bottom surface comprises at least 4 feet, wherein the feet each have a height of about 0.05 inch to about 0.75 inches, wherein the feet are positioned offset from an outer most perimeter of the bottom surface such that the feet are capable of fitting within a perimeter wall of a second similarly shaped and sized stackable leveler.

17. The method of claim 16, wherein the one or more levelers each have the same thickness.

18. The method of claim 16, wherein the one or more levelers have varying thicknesses.

19. The method of claim 16, wherein each of the top and bottom surfaces is substantially circular, oval, square, rectangular, hexagonal, or octagonal.

20. The method of claim 16, wherein each of the feet is substantially circular, oval, square, rectangular, hexagonal, or octagonal.

* * * * *